US006070993A

United States Patent [19]

Natsume

[11] Patent Number: 6,070,993

[45] Date of Patent: Jun. 6, 2000

[54] VEHICLE LAMP

[75] Inventor: Kazunori Natsume, Shizuoka, Japan

[73] Assignee: Koito Manufacturing Co., Ltd., Tokyo, Japan

[21] Appl. No.: 09/098,461

[22] Filed: Jun. 17, 1998

[30] Foreign Application Priority Data

Jun. 18, 1997 [JP] Japan ..... 9-177700

[51] Int. Cl.[7] ..... F21V 7/00

[52] U.S. Cl. ..... 362/309; 362/333; 362/520; 362/522

[58] Field of Search ..... 362/309, 297, 362/516, 517, 518, 333, 348, 320, 321, 322, 299, 520, 521, 522

[56] References Cited

U.S. PATENT DOCUMENTS

| | | | |
|---|---|---|---|
| 838,789 | 12/1906 | Klein | 362/333 |
| 1,245,426 | 11/1917 | Bennett | 362/333 |
| 4,586,116 | 4/1986 | Kasboske | 362/293 |
| 4,994,947 | 2/1991 | Fesko | 362/297 |
| 5,426,294 | 1/1995 | Kobayashi et al. | 362/226 |
| 5,556,194 | 9/1996 | Natsume et al. | 362/229 |
| 5,582,481 | 12/1996 | Natsume | 362/336 |
| 5,584,570 | 12/1996 | Binder et al. | 362/293 |

FOREIGN PATENT DOCUMENTS

| | | | |
|---|---|---|---|
| 0 257 946 | 3/1988 | European Pat. Off. | F21M 3/08 |
| 0 336 478 | 10/1989 | European Pat. Off. | F21V 11/00 |
| 0 678 703 | 10/1995 | European Pat. Off. | F21Q 1/00 |
| 7-230706 | 8/1995 | Japan | F21Q 1/00 |

*Primary Examiner*—Sandra O'Shea
*Assistant Examiner*—John A. Ward
*Attorney, Agent, or Firm*—Sughrue, Mion, Zinn, Macpeak & Seas, PLLC

[57] ABSTRACT

A vehicle lamp comprises: a lamp body; and a lens disposed in front of the lamp body, forming a lamp chamber with the lamp body, wherein at least an area forming part of the inner surface of the lamp body or the lens is divided into a plurality of elements, and the cross sectional configuration of each element in two directions meeting at right angles comprises a concave curve in one direction and a convex curve in the other.

18 Claims, 8 Drawing Sheets

VEHICLE LAMP

BACKGROUND OF INVENTION

The present invention relates to a vehicle lamp and more particularly to an automobile marker lamp or a dummy lamp such as a garnish provided in a position adjacent to the automobile marker lamp.

A typical automobile marker lamp normally has a lamp chamber formed with a lamp body and a lens disposed in front of the lamp body, so that light from a light source bulb in the lamp chamber is diffusion-irradiated forward.

The aforesaid diffusion irradiation is effected by dividing the inner surface of the lamp body into a plurality of reflective surface elements or dividing the inner surface of the lens into a plurality of lens elements. Since the diffusion irradiation is required to diffuse light in the vertical and horizontal directions in view of light distribution of the lamp, however, each of the aforesaid reflective surfaces elements or lens elements has heretofore been provided in the form of a convex element (like a fish eye element) or a concave element.

Such a conventional vehicle lamp has posed a problem in that desired light distribution performance is hardly obtainable and that the lamp lacks neat external appearance when it is seen from the outside.

More specifically, there has been produced a problem arising from the fact that the desired light distribution performance is hardly obtainable from the conventional vehicle lamp when the convex or concave elements are formed as the reflective surface elements because the wall thickness of the central portion of each reflective surface element in the lamp body greatly differs from that of the peripheral portion (corner portion in particular) thereof, which results in lessening the flow properties of molten resin when the reflective surface element is molded, thus hampering the formation of the reflective surface element with precision.

In such a case as stated above, though the substantially central portion of each reflective surface element serves as a luminous portion and lights like a luminous spot because of the reflected light (reflected light of light from the light source when the lamp is turned on or reflected light of light from the outside when the lamp is turned off) when the lamp is seen from the front side of the lamp, the luminous portion is simply moved in the same direction (or reverse direction) as the viewpoint moves when the lamp observing angle is changed from the elevational view of the lamp and even when the viewpoint is changed in direction, since the cross sectional configuration of the reflective surface element has a curve having convex (or concave) curvature in both vertical and horizontal directions. The problem in this case is that the lamp lacks variation in appearance when the lamp observing angle is changed, thus lacking design novelty.

Another problem is that even when a convex or concave element is formed as the lens element, the desired light distribution performance is hardly obtainable because the wall thickness of the central portion of each lens element in the lens greatly differs from that of the peripheral portion (comer portion in particular) thereof, which results in lessening the flow properties of molten resin when the lens is molded, thus hampering the formation of the lens element with precision.

Even in this case, though the substantially central portion of each lens element serves as a luminous portion and lights like a luminous spot because of the reflected light on the inner surface of the lens when the lamp is seen from the front side of the lamp, the luminous portion is simply moved in the same direction (or reverse direction) as the viewpoint moves when the lamp observing angle is changed from the angle as seen from the front side of the lamp and even when the viewpoint is changed in direction, since the cross sectional configuration of the reflective surface element has a curve having convex (or concave) curvature in both vertical and horizontal directions. The problem is that the lamp lacks variation in appearance when the lamp observing angle is changed, thus lacking design novelty.

SUMMAY OF INVENTION

An object of the present invention made under the foregoing circumstances is to provide a vehicle lamp so arranged as to have light from a light source bulb diffusion-reflected forward in vertical and horizontal directions, to make the desired light distribution performance obtainable and to offer neat external appearance when the vehicle lamp is seen from the outside.

Another object of the present invention is to provide a dummy vehicle lamp without having a light source bulb so that the vehicle lamp offers neat external appearance when it is seen from the outside.

The present invention is intended to accomplish the objects above by providing newly contrived structure for a plurality of elements constituting the inner surface of a lamp body or a lens.

According the present invention, there is provided a vehicle lamp comprising a lamp chamber formed with a lamp body and a lens disposed in front of the lamp body, wherein at least an area forming part of the inner surface of the lamp body or the lens is divided into a plurality of elements, and the cross sectional configuration of each element in two directions meeting at right angles comprises a concave curve in one direction and a convex curve in the other.

The aforesaid "vehicle lamp" conceptually includes an ordinary vehicle lamp having a light source bulb provided in the aforesaid lamp chamber and also a dummy vehicle lamp having no light source bulb provided therein.

As shown in the above arrangement, according to the present invention, at least the area forming part of the inner surface of the lamp body or the lens is divided into the plurality of elements, and the cross sectional configuration of each element in two directions meeting at right angles comprises a concave curve in one direction and a convex curve in the other (i.e., the surface configuration of each element is like a so-called horse saddle), so that the wall thickness of the central and peripheral (particularly comer) portions of the element is uniformized in comparison with a conventional case where the surface configuration of each element has been made convex or concave.

Although the difference h' in wall thickness between the central portion of a rectangular element s' having a convex surface configuration and the comer portion thereof is h1−h2 as shown in FIG. 1(*b*), the difference h in wall thickness between the central portion of a rectangular element s having a surface configuration similar to a horse saddle and the comer portion thereof is |h1−h2 | and thus h<<h'.

Since the wall thickness of the central and peripheral (particularly comer) portions of each element can thus be uniformized according to the present invention, the flow properties of the molten resin is made improvable when the lamp body or the lens is molded, whereby the element is formable with precision. In consequence, the desired light distribution performance becomes obtainable from the lamp.

In the case where the surface configuration of each element is formed like a horse saddle, the substantially central portion of each element serves as a luminous portion and lights like a luminous spot because of the reflected light (reflected light of light from the light source when the lamp is turned on or reflected light of light from the outside when the lamp is turned off) when the lamp is seen from the front side of the lamp as in the conventional case where the convex or concave surface is formed. However, since the cross sectional curvatures of each element in two directions meeting at right angles are set opposite to each other, the moving direction of the aforesaid luminous portion differs depending on the direction in which the viewpoint is moved when the lamp observing angle is changed from the elevational view of the lamp.

When each element is formed on the inner surface of the lamp body (inner surface of the lens) and when it is assumed that its cross sectional configuration has a concave curve in the vertical direction and a convex curve in the horizontal direction, the aforesaid luminous portion is moved downward (upward) as the viewpoint moves when the lamp observing angle is changed upward from the elevational view of the lamp. Further, the luminous portion is moved to the right (left) as the viewpoint moves when the lamp observing angle is changed to the right from the elevational view of the lamp, and it is moved to the diagonally lower right (diagonally upper left) as the viewpoint moves when the lamp observing angle is changed to the diagonally upper right therefrom.

Therefore, the appearance becomes full of variety when the lamp observing angle is changed to ensure that design novelty is secured.

Since the vehicle lamp is so arranged as to have the light from the light source bulb diffusion-reflected forward in the vertical and horizontal directions according to the present invention, not only the desired light distribution but also neat external appearance as seen from the outside is easily obtainable and besides neat external appearance is obtainable from the dummy vehicle lamp without a light source bulb. In a case where the vehicle lamp and the dummy vehicle lamp are disposed side by side, lamp-to-lamp design continuity can be secured.

In the arrangement above, the "outer shape" of each element is not specifically restricted but may be substantially rectangular as seen from the front side of the lamp and a boundary line between the elements is set to extend in both horizontal and vertical directions, whereby design novelty can be expressed on the basis of a regulated pattern such as a grid or brick wall pattern. Furthermore, the aforesaid design novelty can be expressed on the basis of a regulated pattern such as a flower petal or cobweb pattern by making the outer shape of the element fan-like when the element is seen from the front side of the lamp and setting the element-to-element boundary line extending in the radial and circumferential directions centering on a predetermined point.

Incidentally, the configuration of a reference surface in the area where the plurality of elements are divisionally formed on the inner surface of the lamp body or the lens is not specifically restricted but may be planar or have any curved surface. When the plurality of elements are formed on the inner surface of the lamp body in the ordinary vehicle lamp provided with the light source bulb in the lamp chamber, as described in claim 4 according to the present invention, the plurality of elements are laid out on a paraboloid of revolution with an axis extending in the longitudinal direction of the lamp as a center axis, and light from the light source bulb is arranged so that it is diffusion-reflected forward in both vertical and horizontal directions, whereby the diffusion light can be irradiated in a well-balanced manner vertically and horizontally with respect to the right front direction of the lamp.

DETAILED DESCRIPTION OF PREFERRED EMBODIMENTS

Figure 1A:
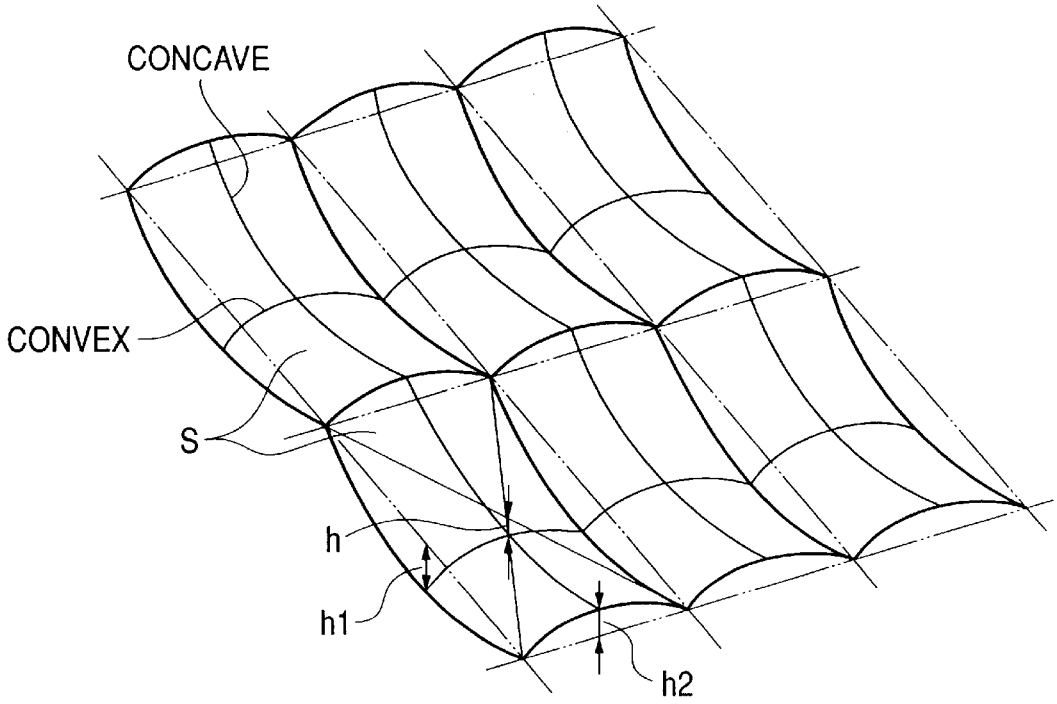
FIG. 1(*a*) is a perspective view illustrating a vehicle lamp according to a first embodiment of the present invention, and FIG. 1(*b*) is a prespective view of a conventional lamp.

Referring to the drawings, there is given a description of a mode for carrying out the invention.

First, an embodiment of the present invention will be described.

Figure 2:
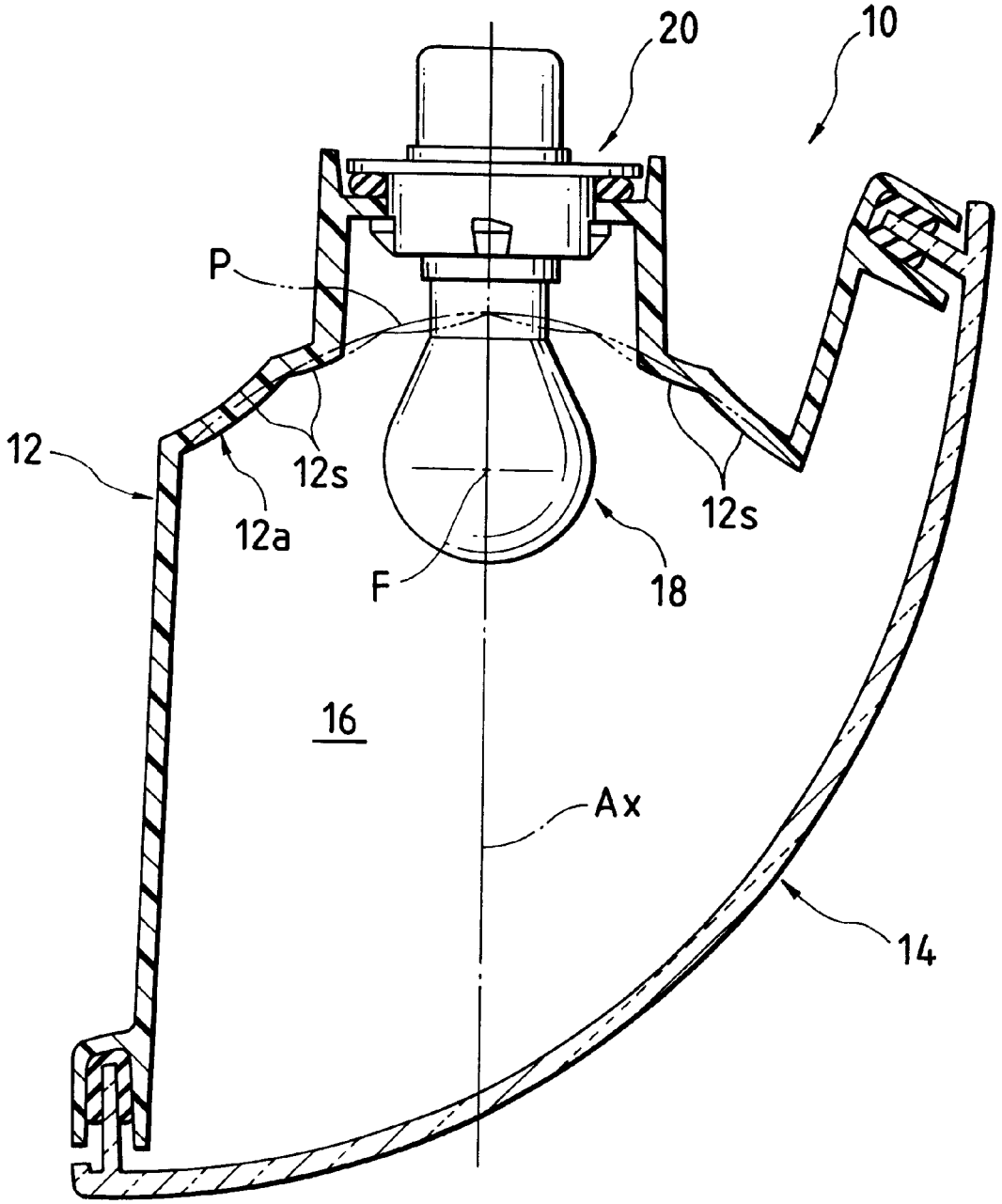
FIG. 2 is a horizontal sectional view of the vehicle lamp according to the first embodiment of the invention.
Figure 3:
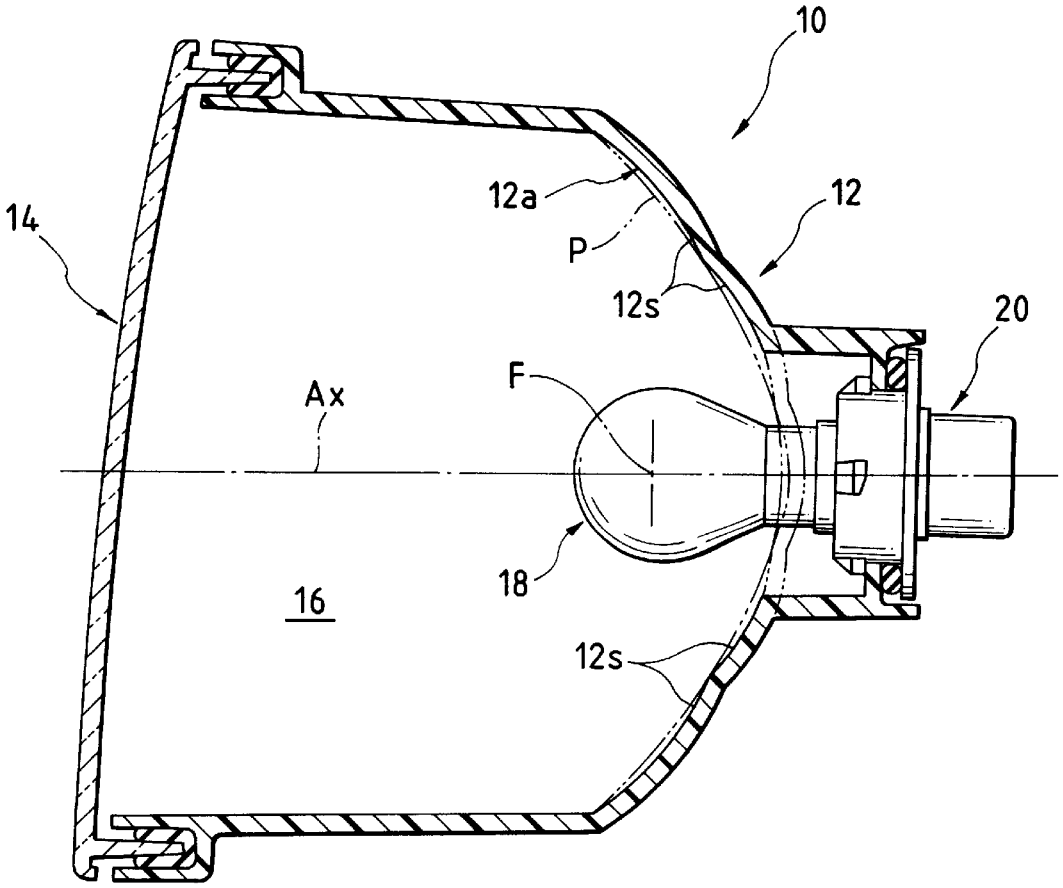
FIG. 3 is a side sectional view of the vehicle lamp according to the first embodiment of the invention.

FIG. 2 a horizontal sectional view of a vehicle lamp according to a first embodiment of the present invention; FIG. 3, a side sectional view thereof; and FIG. 4, an elevational view of the vehicle lamp without a lens.

As shown in these drawings, a lamp body 10 according to this embodiment of the invention is a marker lamp (clearance lamp) installed in the left-hand front end corner of an automobile body, the marker lamp comprising a plastic lamp body 12, a plastic lens 14 disposed in front of the lamp body 12, and a light source bulb 18 provided in a lamp chamber 16 formed with the lamp body 12 and the lens 14.

A plurality of reflective surface elements 12*s* are formed on a paraboloid of revolution P with an axis Ax extending in the longitudinal direction of the lamp (longitudinal direction of a vehicle body) as its center axis on the inner surface 12*a* of the lamp body 12, so that the lamp body 12 demonstrates the function of a reflector. Further, the light source bulb 18 is mounted on the lamp body 12 via a socket 20 in such a manner that its filament (not shown) is positioned at the focal point F of the paraboloid of revolution P on the axis Ax. Further, the lens 14 is curved so that the outer region of the lens in the vehicle width direction rounds backward in harmony with the configuration of the left-hand front end comer of the body.

Figure 4:
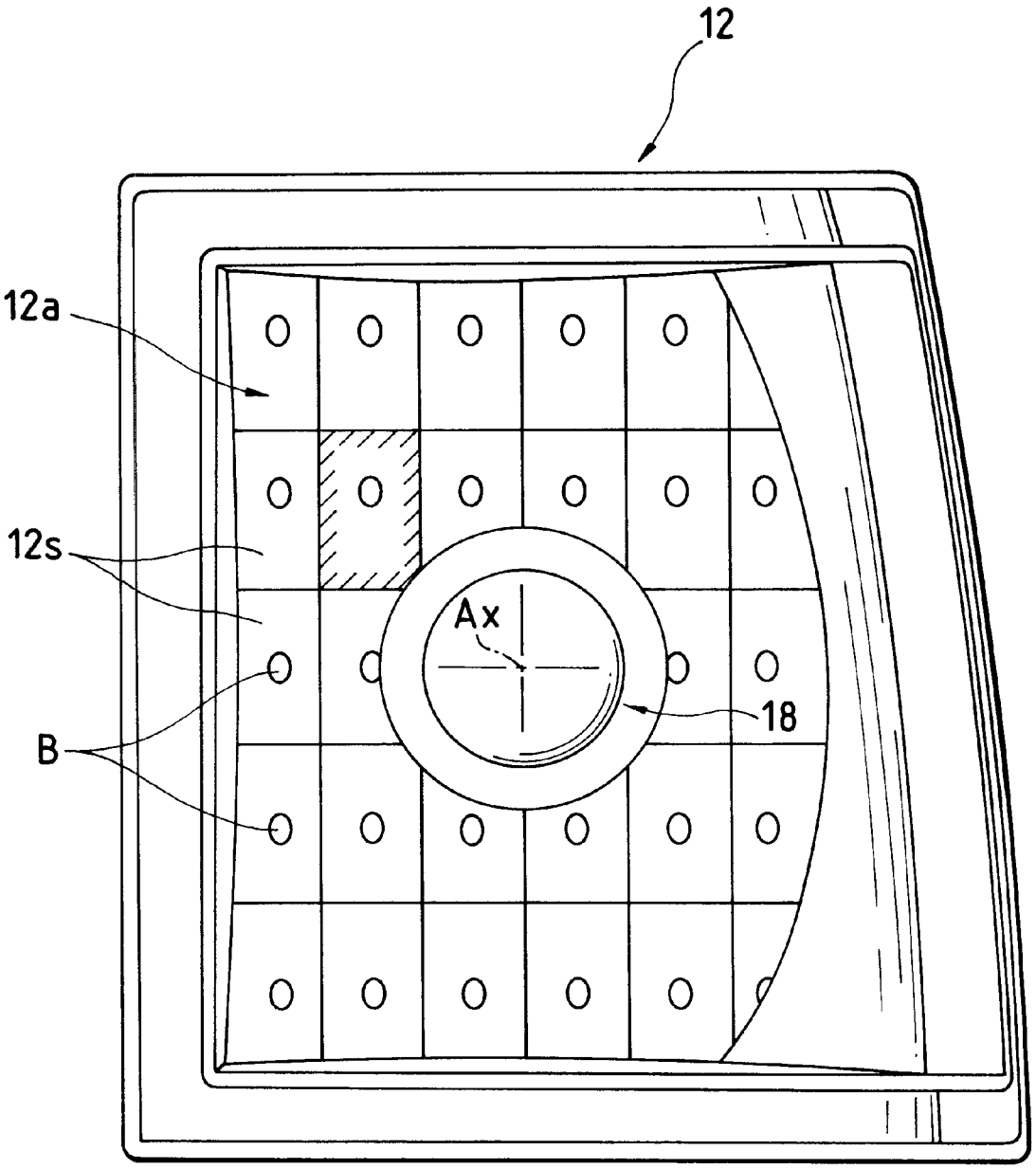
FIG. 4 is an elevational view of the vehicle lamp without the lens according to the first embodiment of the invention.

As shown in FIG. 4, the reflective surface elements 12*s* are respectively allocated to a plurality of segments in the form of a grid, the segment having a concave curve in the vertical direction and a convex curve in the horizontal direction. Further, each reflective surface element 12*s* is used to have light from the light source bulb 18 diffusion-reflected forward in both vertical and horizontal directions.

The lamp 10 according to this embodiment of the invention is adapted to accomplish the light distribution function of the lamp by causing the light from the light source bulb 18 to be diffusion-reflected on the inner surface 12*a* of the lamp body 12, and the lens 14 is made a simple see-through lens.

When the inner surface 12*a* of the lamp body 12 is seen from the front side of the lamp in the on-state of the light source bulb 18, the substantially central portion (the shifting of its position occurs depending on the position where the reflective surface element 12*s* is formed) of each reflective surface element 12*s* appears to be a luminous portion B like a luminous spot.

Figure 5:
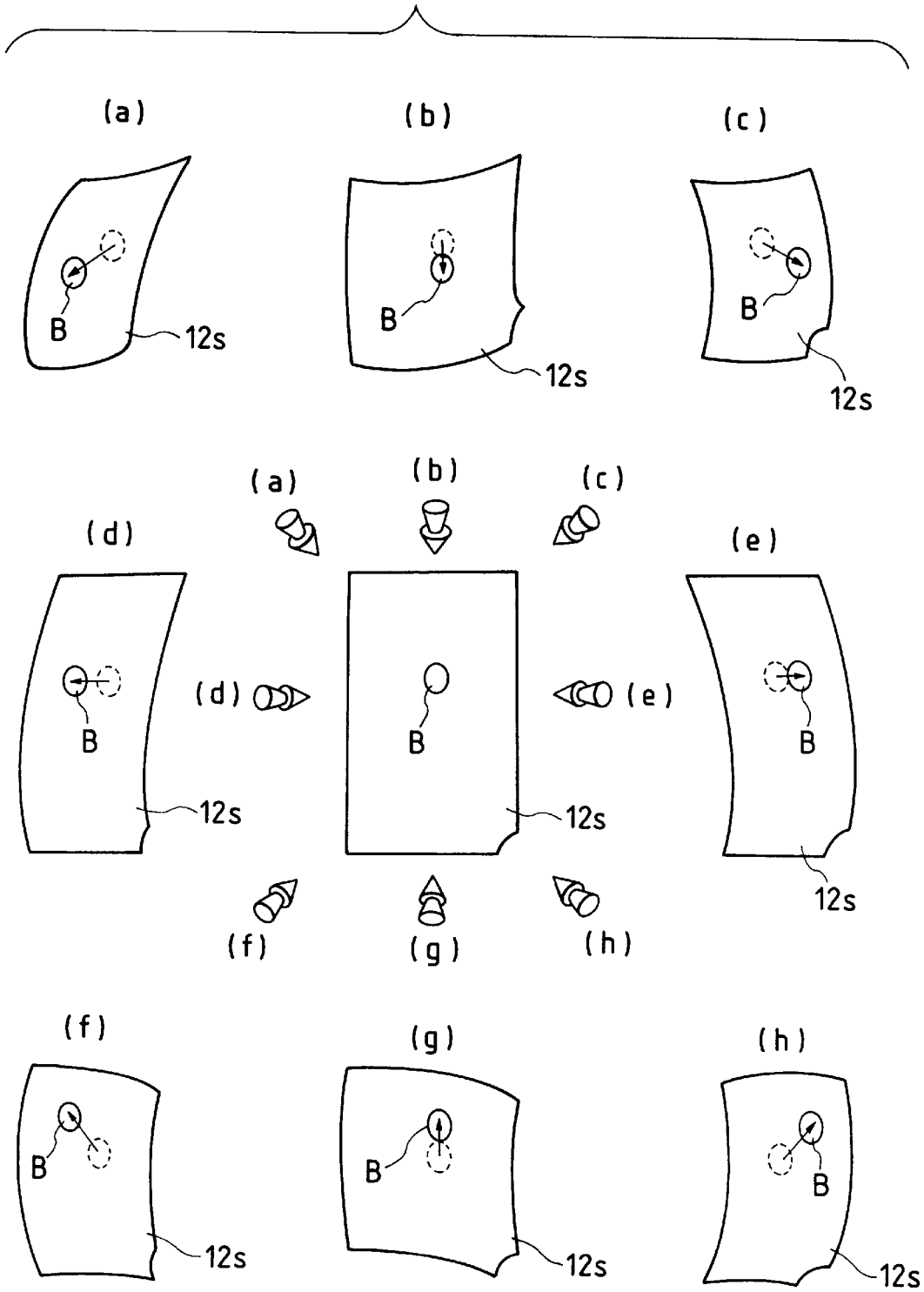
FIG. 5 is a diagram illustrating the function of the first embodiment of the invention.

FIG. 5 is a diagram illustrating variations of the position of the luminous portion B when the reflective surface element 12*s* framed with slant lines in FIG. 4 is taken out and seen from the front side of the lamp at different angles.

Since the cross sectional configuration in the vertical direction of the reflective surface element 12*s* is a concave curve and the cross sectional configuration in the horizontal direction thereof is a convex curve, the luminous portion B is moved downward (upward) opposite to the direction in which the viewpoint moves when the lamp observing angle is changed upward (downward) from the elevational view of the lamp; the luminous portion B is moved to the right (left), that is, the same direction in which the viewpoint moves when the lamp observing angle is changed to the right (left) from the elevational view of the lamp; and the luminous portion B is moved to the diagonally lower right (diagonally upper right) crossing the viewpoint at right angles when the lamp observing angle is changed to the diagonally upper right (diagonally lower right) or diagonally upper left (diagonally lower left) therefrom.

Although the luminous portion subjected to reflected light from the outside in the off-state of the lamp is formed in a position slightly different from the luminous portion B in each reflective surface element 12*s*, variations of the position of the former luminous portion when the viewpoint is changed from the elevational view of the lamp are similar to those of the luminous portion B.

Figure 1B:
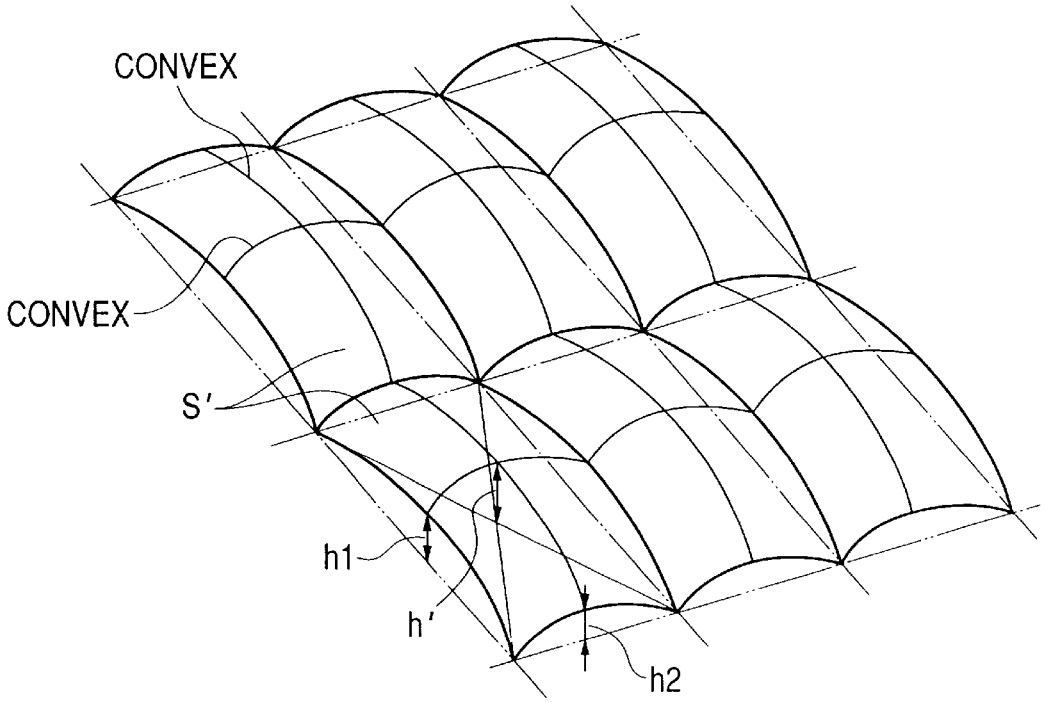

As set forth above in detail, since the cross sectional configuration of the reflective surface element 12*s* constituting the inner surface 12*a* of the lamp body 12 is formed like a horse saddle according to this embodiment of the invention, the wall thickness of the central and peripheral (particularly corner) portions of the element is uniformized in comparison with a conventional case where the surface configuration of each element has been made convex or concave (see FIG. 1).

As the flow properties of the molten resin is made improvable when the lamp body 12 is molded, the reflective surface element 12*s* is formable with precision. In consequence, the desired light distribution performance becomes obtainable from the lamp.

Since the surface configuration of the reflective surface element 12*s* is also formed like a horse saddle, the luminous portion B appearing luminous in the reflective surface element 12*s* as the viewpoint moves is moved in a different direction when the lamp observing angle is changed from the elevational view of the lamp and the appearance becomes full of variety when the lamp observing angle is changed to ensure that design novelty is secured.

As the vehicle lamp is arranged so that light from the light source bulb is diffusion-reflected forward in both vertical and horizontal directions according to this embodiment of the invention, the desired light distribution is easily obtainable from the lamp with neat appearance when it is seen from the outside.

The aforesaid design novelty can be expressed on the basis of a regulated pattern such as a grid pattern according to this embodiment of the invention.

A second embodiment of the present invention will subsequently be described.

Figure 6:
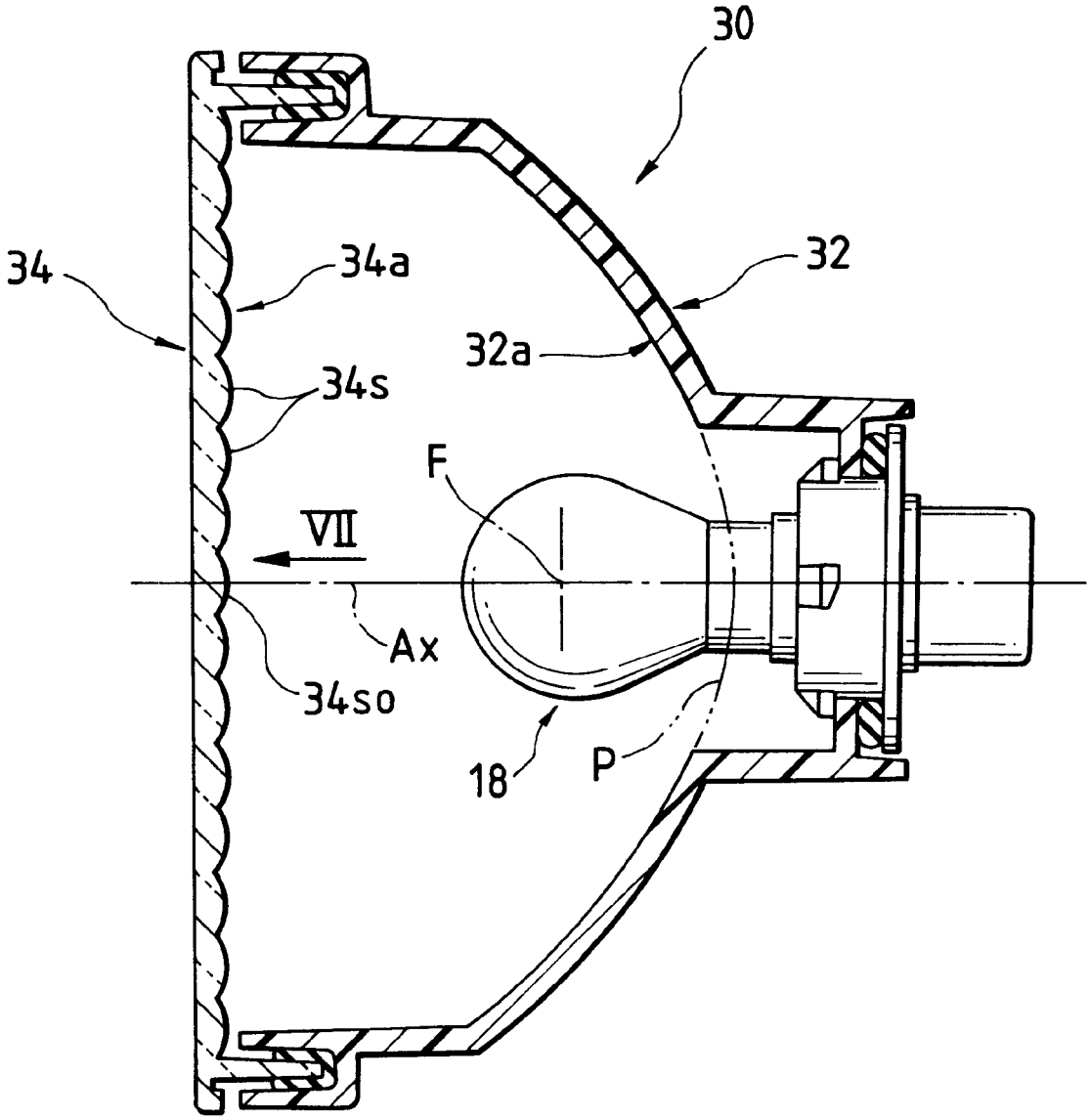
FIG. 6 is a side sectional view of a vehicle lamp according to a second embodiment of the invention.
Figure 7:
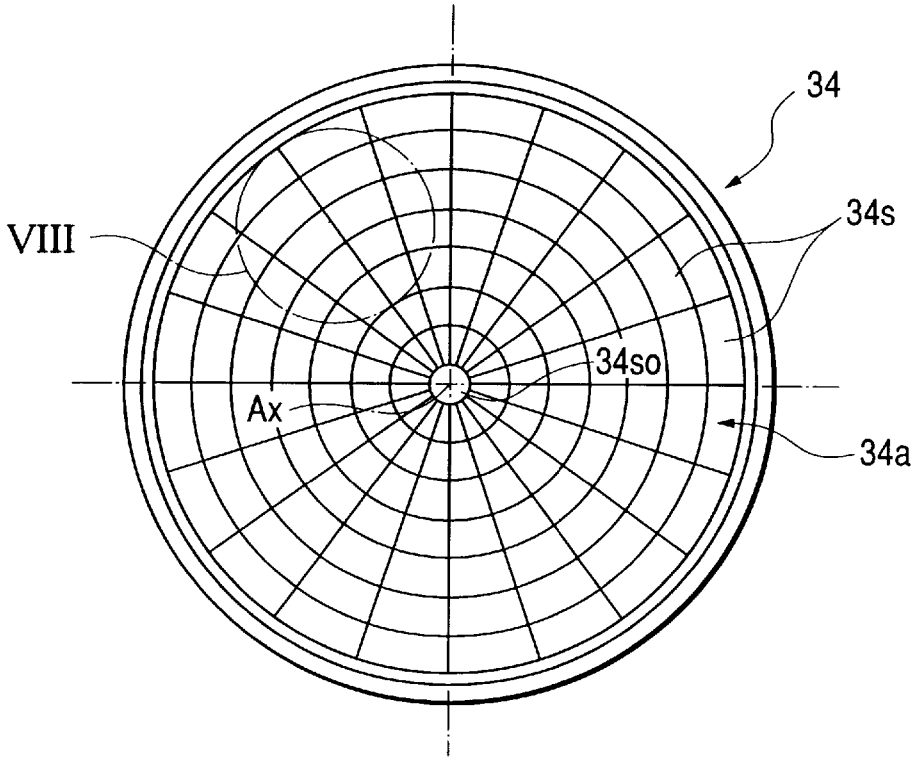
FIG. 7 is a diagram illustrating a single article of lens in the vehicle lamp according to the second embodiment of the invention as viewed from an arrow VII of FIG. 6.
Figure 8:
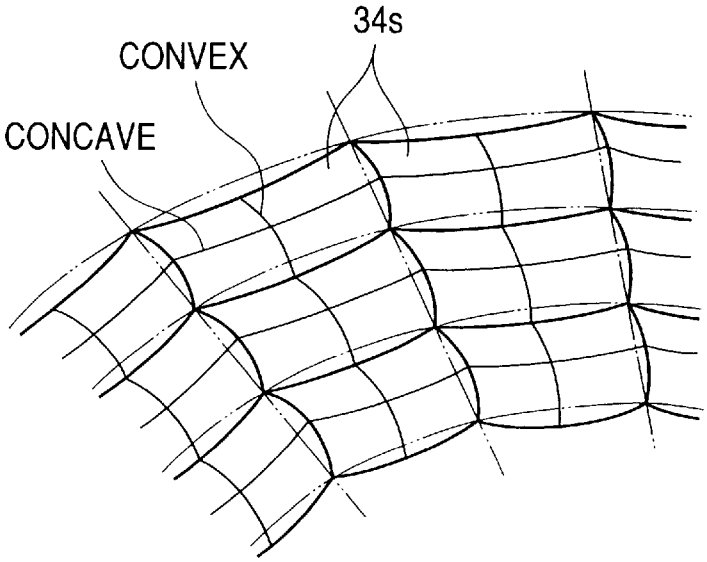
FIG. 8 is an enlarged perspective view of VIII portion of FIG. 7.

FIG. 6 is a side sectional view of a vehicle lamp according to this embodiment of the invention; FIG. 7, a sectional view taken along an arrow VII of FIG. 6, illustrating a single article of the vehicle lamp; and FIG. 8, an enlarged perspective view of a portion VIII of FIG. 7.

A lamp 30 according to this embodiment of the invention is a circular marker lamp in elevational view and the inner surface 32*a* of a lamp body 32 is a paraboloid of revolution P with an axis Ax extending in the longitudinal direction of a vehicle body as its center axis, so that light from the light source bulb 18 is reflected forward as parallel rays of light.

On the other hand, the lens 34 of the lamp 30 is formed flat and a plurality of lens elements 34*s* are formed on the inner surface 34*a* of the lens 34. Each of the lens elements 34*s* is allocated to each of the fan-shaped segments thus divided by boundary lines extending in radial and circumferential directions centering on the axis Ax (excluding a lens element 34so positioned on the axis Ax), and the cross sectional configuration of the lens element in the radial direction has a convex curve and that in the circumferential direction has a concave curve. Each lens element 34*s* is used to diffusion-transmit the light reflected from the inner surface 32*a* of the lamp body 32 in the radial and circumferential directions (i.e., in the vertical and horizontal directions). The lens element 34so is formed as a fish eye lens element.

As set forth above in detail, since the cross sectional configuration of the element 34*s* constituting the inner surface 34*a* of the lens 34 is formed like a horse saddle according to this embodiment of the invention, the wall thickness of the central and peripheral (particularly comer) portions of the element is uniformized in comparison with a conventional case where the cross sectional configuration of each lens element has been made convex or concave.

As the flow properties of the molten resin is made improvable when the lens 34 is formed, the lens element 34*s* is formable with precision. In consequence, the desired light distribution performance becomes obtainable from the lamp.

Since the surface configuration of the lens element 34*s* is also formed like a horse saddle, the luminous portion B appearing luminous in the lens element 34*s* as the viewpoint moves is moved in a different direction when the lamp observing angle is changed from the elevational view of the lamp, and the appearance becomes full of variety when the lamp observing angle is changed to ensure that design novelty is secured.

As the vehicle lamp is arranged so that light from the light source bulb is diffusion-reflected forward in both vertical and horizontal directions according to this embodiment of the invention, the desired light distribution is easily obtainable from the lamp with neat appearance when it is seen from the outside.

The aforesaid design novelty can be expressed on the basis of a regulated pattern such as a grid pattern according to this embodiment of the invention.

A third embodiment of the present invention will subsequently be described.

Figure 9:
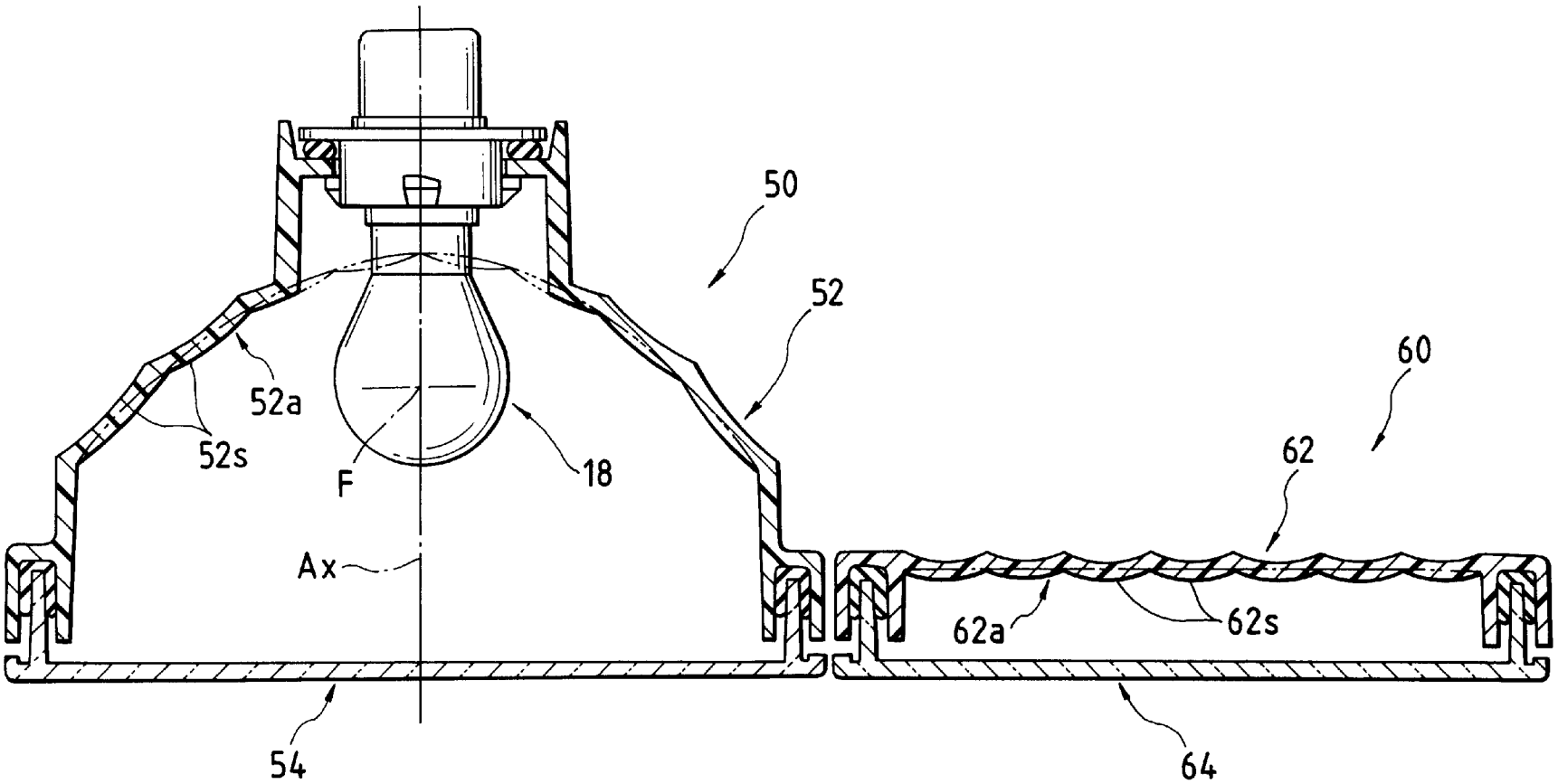
FIG. 9 is a horizontal sectional view of a vehicle lamp according to a third embodiment of the invention.

FIG. 9 is a horizontal sectional view of a vehicle lamp according to this embodiment of the invention.

As shown in FIG. 9, an ordinary lamp (a marker lamp) 50 having the light source bulb 18 and a dummy lamp (garnish) without having a light source bulb are installed side by side.

Although the inner surface 52*a* of the lamp body 52 of the lamp 50 is the same as that of the lamp body 12 according to the first embodiment of the invention, the lens 54 of the lamp 50 is formed flat. However, the lens 54 is a simple see-through lens like the lens 14 according to the first embodiment of the invention.

On the other hand, a dummy lamp 60 only has a lamp body 62 and a lens 64 disposed in front of the lamp body 62. The lens 64 is a flat simple see-through lens and leveled with the lens 54.

Further, a plurality of reflective surface elements 62*s* are formed on the inner surface 62*a* of the lamp body 62, that is, on a plane (shown with a chain double-dashed line) in parallel to the lens 54. Like the reflective surface elements 52*s* formed on the inner surface 54*a* of the lamp body 52 of the lamp 50, the reflective surface elements 62*s* are respectively allocated to a plurality of segments in the form of a grid, and the cross sectional configuration of each element has a concave curve in the vertical direction and a convex curve in the horizontal direction.

As set forth above in detail, since the plurality of reflective surface elements 62*s* like the reflective surface elements 52*s* formed on the inner surface 52*a* of the lamp body 52 of the lamp 50 are formed on the inner surface 62*a* of the lamp body 62 of the dummy lamp 60 according to this embodiment of the invention, the appearance becomes full of variety when the lamp observing angle with the dummy lamp 60 is changed to ensure that design novelty is secured.

When the lamp 50 and the dummy lamp 60 thus set adjacent to each other according to this embodiment of the present invention are seen from the outside, the luminous portion formed in each reflective surface element 52*s* of the lamp 50 and what is formed in each reflective surface element 62*s* of the dummy lamp 60 because of the reflected light of light from the outside of the lamps behave substantially in the same mode as the viewpoint moves from the elevational view of the lamps, whereby design continuity between both the lamps 50, 60 can be secured.

What is claimed is:

1. A vehicle lamp comprising:

a lamp body; and a lens disposed in front of the lamp body, forming a lamp chamber with the lamp body, wherein at least an area forming part of the inner surface of the lamp body or the lens is divided into a plurality of elements, and the cross sectional configuration of each element in two directions meeting at right angles comprises a concave curve in one direction and a convex curve in the other.

2. The vehicle lamp as claimed in claim 1, further comprising:

a light source bulb in the lamp chamber, wherein the plurality of elements are laid out on a paraboloid of revolution with an axis extending in the longitudinal direction of the lamp as a center axis and wherein light from the light source bulb is arranged so that it is diffusion-reflected forward in both vertical and horizontal directions.

3. The vehicle lamp as claimed in claim 1, wherein the outer shape of each element is substantially rectangular as seen from the front side of the lamp and wherein a boundary line between the elements is set to extend in both horizontal and vertical directions.

4. The vehicle lamp as claimed in claim 3, further comprising:

a light source bulb in the lamp chamber, wherein the plurality of elements are laid out on a paraboloid of revolution with an axis extending in the longitudinal direction of the lamp as a center axis and wherein light from the light source bulb is arranged so that it is diffusion-reflected forward in both vertical and horizontal directions.

5. The vehicle lamp as claimed in claim 1, wherein the outer shape of each element is substantially fan-shaped as seen from the front side of the lamp and wherein a boundary line between the elements as seen from the front side thereof is set to extend in both radial and circumferential directions centering on a predetermined point.

6. The vehicle lamp as claimed in claim 5, further comprising:

a light source bulb in the lamp chamber, wherein the plurality of elements are laid out on a paraboloid of revolution with an axis extending in the longitudinal direction of the lamp as a center axis and wherein light from the light source bulb is arranged so that it is diffusion-reflected forward in both vertical and horizontal directions.

7. The vehicle lamp as claimed in claim 1, wherein the plurality of elements are made of resin.

8. The vehicle lamp as claimed in claim 1, wherein a thickness of a central portion of each element is similar to that of corner portions of the element.

9. A vehicle lamp comprising:

a lamp body; and a lens disposed in front of the lamp body, forming a lamp chamber with the lamp body, and wherein an area forming part of an inner surface of the lamp body is divided into a plurality of elements, and the cross sectional configuration of each element in two directions meeting at right angles comprises a concave curve in one direction and a convex curve in the other.

10. A vehicle lamp comprising:

a lamp body; and a lens disposed in front of the lamp body, forming a lamp chamber with the lamp body, and wherein an area forming part of the lens is divided into a plurality of elements, and the cross sectional configuration of each element in two directions meeting at right angles comprises a concave curve in one direction and a convex curve in the other.

11. A vehicle lamp comprising:

a lamp body; and a lens disposed in front of the lamp body, forming a lamp chamber with the lamp body, and wherein at least an area forming part of an inner surface of the lamp body or the lens is divided into a plurality of elements, and wherein each of said plurality of elements has a configuration in a shape of a saddle.

12. The vehicle lamp as claimed in claim 11, further comprising:

a light source bulb in the lamp chamber, wherein the plurality of elements are laid out on a paraboloid of revolution with an axis extending in a longitudinal direction of the lamp as a center axis and wherein light from the light source bulb is diffusion-reflected forward in both vertical and horizontal directions.

13. The vehicle lamp as claimed in claim 11, wherein an outer shape of each element is substantially rectangular as seen from a front side of the lamp and wherein a boundary line between the elements is set to extend in both horizontal and vertical directions.

14. The vehicle lamp as claimed in claim 13, further comprising:

a light source bulb in the lamp chamber, wherein the plurality of elements are laid out on a paraboloid of revolution with an axis extending in a longitudinal direction of the lamp as a center axis and wherein light from the light source bulb is diffusion-reflected forward in both vertical and horizontal directions.

15. The vehicle lamp as claimed in claim 11, wherein an outer shape of each element is substantially fan-shaped as seen from a front side of the lamp and wherein a boundary line between the elements as seen from the front side thereof is set to extend in both radial and circumferential directions centering on a predetermined point.

16. The vehicle lamp as claimed in claim 15, further comprising:

a light source bulb in the lamp chamber, wherein the plurality of elements are laid out on a paraboloid of revolution with an axis extending in a longitudinal direction of the lamp as a center axis and wherein light from the light source bulb is diffusion-reflected forward in both vertical and horizontal directions.

17. The vehicle lamp as claimed in claim 11, wherein the plurality of elements are made of resin.

18. The vehicle lamp as claimed in claim 11, wherein a thickness of a central portion of each element is similar to that of comer portions of the element.

* * * * *